US006755144B1

(12) United States Patent
Hocquet et al.

(10) Patent No.: US 6,755,144 B1
(45) Date of Patent: Jun. 29, 2004

(54) TOWED LINE FLOATER

(75) Inventors: Philippe Hocquet, Vanves (FR); Loic Pierre Boudet, Bois-Guillaume (FR)

(73) Assignee: Westerngeco AS, Stavanger (NO)

( * ) Notice: Subject to any disclaimer, the term of this patent is extended or adjusted under 35 U.S.C. 154(b) by 0 days.

(21) Appl. No.: 10/031,040

(22) PCT Filed: Jul. 13, 2000

(86) PCT No.: PCT/FR00/02030

§ 371 (c)(1),
(2), (4) Date: Sep. 11, 2002

(87) PCT Pub. No.: WO01/05648

PCT Pub. Date: Jan. 25, 2001

(30) Foreign Application Priority Data

Jul. 16, 1999 (FR) ..... 99 09249

(51) Int. Cl.[7] ..... B63B 21/56
(52) U.S. Cl. ..... 114/242; 114/253
(58) Field of Search ..... 114/242, 244, 114/246, 253

(56) References Cited

U.S. PATENT DOCUMENTS 3,760,761 A 9/1973 Umazume
4,549,499 A 10/1985 Huffhines et al.
4,729,333 A * 3/1988 Kirby et al. ..... 114/244
5,546,882 A * 8/1996 Kuche ..... 114/244
5,829,184 A * 11/1998 Studanski ..... 43/43.13

FOREIGN PATENT DOCUMENTS

FR 0123648 A1 * 10/1984 ..... 114/244
GB 2 031 361 A 4/1980
GB 2 193 476 A 2/1988

* cited by examiner

*Primary Examiner*—Stephen Avila
(74) *Attorney, Agent, or Firm*—Pearne & Gordon LLP

(57) ABSTRACT

This float comprises a fuselage (6) analogous to classic floats, but which here is topped by a leg (7) such that the fuselage (6) is completely submerged. This arrangement, combined with others that are secondary, makes it possible to reduce the vertical oscillations of the float produced by the sea swell while still ensuring good directional stability and satisfactory stability relative to other disturbances. Thus, a structure (1) suspended from the float (5) and which is part of a line (2, 3) towed by a ship remains at a constant depth. This invention can be applied, for example, to seismic tests at sea.

22 Claims, 1 Drawing Sheet

TOWED LINE FLOATER

The present invention relates to a float for a towed line, whose field of application is generally seismic measurements at sea, in which a battery of lines carrying acoustic sensors is towed at the stern of a ship. Each of the lines comprises a deflector in front of the sensors, which is a submerged and vertical wing which incurs a transversal lift and maintains the line alongside the wake of the ship, and a float from which the deflector is suspended and whose aim is to prevent the line from sinking under the weight of the deflector.

The floats must be almost insensitive to the disturbances to which they may be submitted, in particular by the sea swell. Unfortunately, as far as this is concerned, the known floats oscillate too easily in the vertical direction following the movements of the swell. The suspension line of the float deflector is submitted to periodic surges which can end by fatigue rupture or can create damage to the connections, and the quality of measurement can also be disturbed. The float to be described below overcomes this disadvantage while still retaining good directional stability, above all in its most advantageous embodiment.

The known floats have a fuselage shape, expanded in the centre and progressively tapered towards the ends. The float according to the invention comprises a horizontal portion of the floating body whose shape is also substantially fuselage shaped, but also an upper part of the floating body, extending from the horizontal portion upwards and with horizontal cross-sections which are closely uniform; in addition, the horizontal portion is completely submerged and the upper portion is partially emerged when the float holds the line, or a heavy element of the latter.

The vertical movement of the sea swell is therefore represented above all by a variation of the immersion of the upper portion without any special force on the float because of the uniformity of its cross-section and the small variation of the submerged volume: the vertical oscillating movement of the float and its load therefore does not have a great amplitude.

The stability is still better if the upper portion is erected at the rear of the horizontal portion, and particularly if the suspension element of the deflector is located in front of the upper portion.

If this suspension element comprises a single articulation around a transversal axis, the float is restrained from rolling movements and comes back into place more easily.

The directional stability of the float is improved if its horizontal portion is wider than its height, which makes it possible to reduce its lateral surface, and thus the lateral disturbing forces.

The invention will now be described with the aid of the figures below, showing one embodiment:

Figure 1:
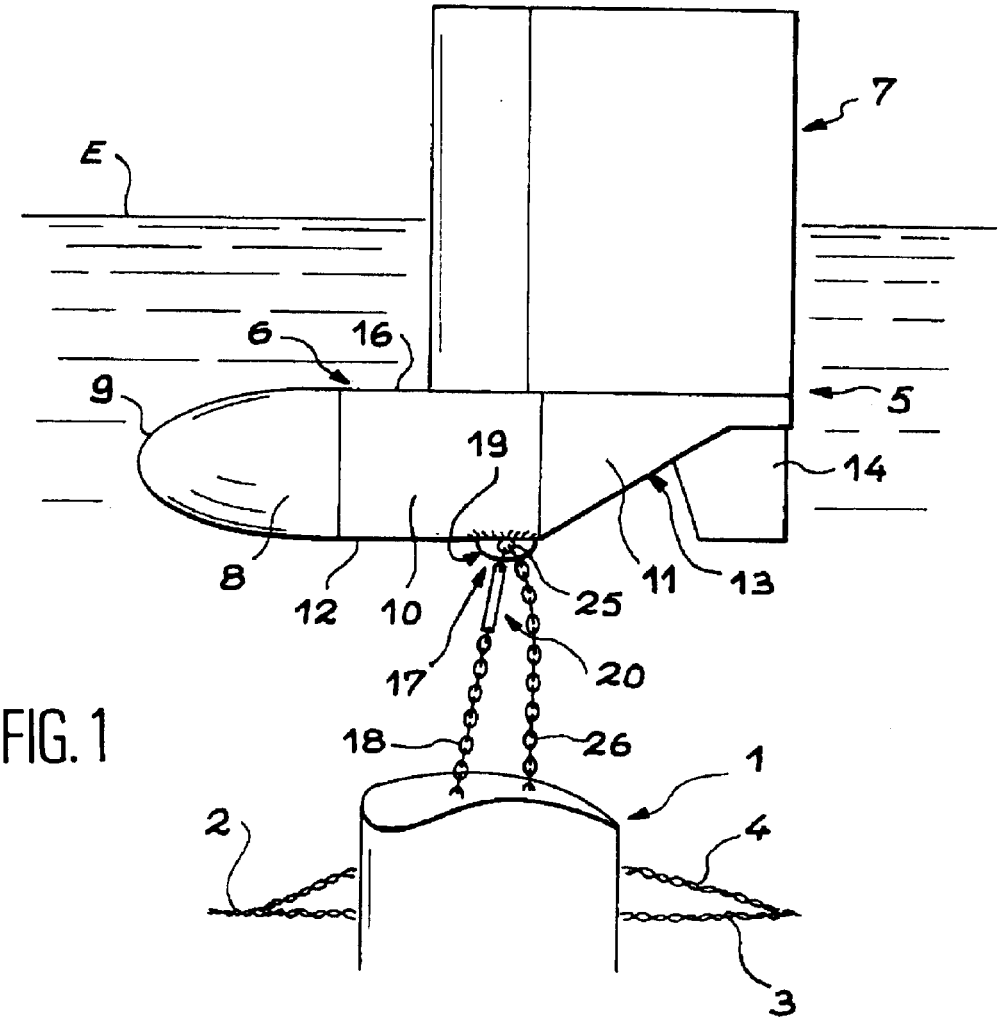
FIG. 1 is a side view of the float.

A part of the line towed for seismic measurements is shown in FIG. 1. It comprises, on either side of a submerged deflector 1, a front portion of line 2 attached to a ship located on the left and a rear portion of line 3 to which the sensors are attached located on the right (outside the figure). In addition, a line deviation 4 links the fore and aft portions 2 and 3 avoiding the deflector 1, and serves for transmitting the signal from the sensors to the ship. The deflector 1 is maintained at a closely constant depth thanks to a float 5, characteristic of the invention, preventing it from sinking lower, whether it is suspended by a cable or by a chain 18.

Figure 3:
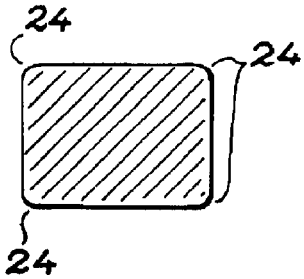
FIG. 3 is a cross-section of the float along the line III—III.
Figure 2:
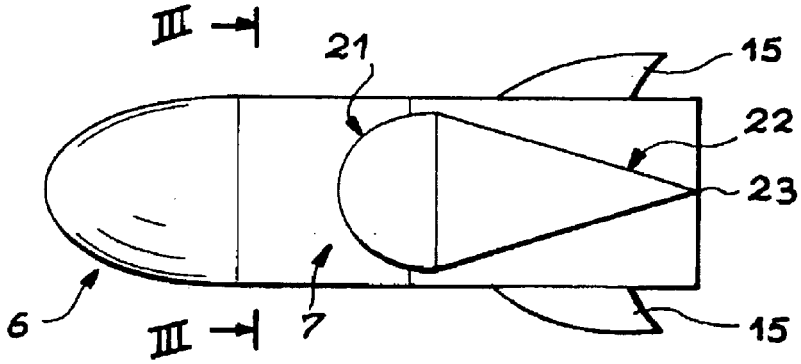
FIG. 2 is a view from above the float.

The float 5 comprises a horizontal and lower portion of a floating body here called a fuselage 6 and an upper vertical portion of a floating body called a leg 7. The fuselage 6 has: a front portion 8 intended to promote penetration in the water and which is therefore tapered towards the front, as far as a rounded end 9; a median portion 10 of closely uniform cross-section; and a rear portion 11 reducing towards the rear, a base surface 12 of the fuselage 6 at this point having a rising step 13 to recede upwards and to form a concave housing for a vertical fin 14; other fins, horizontal, 15, are placed on the sides of the fuselage 6. The horizontal fins 15 are a disadvantage in that they increase the transversal dimensions of the float 5, but they can be made detachable or retractable to make them disappear when the float 5 is on board the ship. It is advantageous for the cross-sections of the fuselage 6 to be closely rectangular and for its faces to be defined by the edges 24 forming almost sharp edges as shown in FIG. 3. Preferably, the base 12 is flat over the greater part of its length, particularly in the median part 10, and the upper surface of the fuselage 6 forms an upper flat deck 16 between the median part 10 and the rear part 11.

Advantageously, the leg 7 is at the back of the fuselage 6 and extends substantially over half of its length, substantially over the whole of the rear part 11 and over half of the median part 10. A suspension element 17 of the deflector 1 by the chain 18 is attached to the base 12, and comprises a coupling 19 fixed to the fuselage 6, a connecting rod 20 connected to the chain 18 and a transversal axis articulation 25 between them, which thus makes it possible for the connecting rod 20 to oscillate backwards and forwards but not laterally, such that the deflector 1 helps to stabilise the float 5 against rolling movements by restraining its rotation around the longitudinal axis. A safety chain 26 could further unite the deflector 1 to the coupling 19 and support it if the suspension element 17 were to break. The connecting rod 20 can include a shock absorber.

The leg 7 is substantially half-submerged under the surface of the water E and comprises a front portion 21 rounded as a half-cylinder to promote penetration, and a rear portion 22 formed of two surfaces joined together at an edge 23 located at the rear. The leg 7 is smooth, with substantially identical cross-sections, in order to limit the forces produced by the vertical movements of the sea swell.

The mechanical principle sought consists generally of making the actual frequency of heaving (vertical oscillatory movement) of the float 5 close to a value where the movements of the swell only exert a minimum force, which attenuates the forces on the suspension element 17. The dimensions of the fuselage 6 and the cross-section of the leg 7 can be chosen in consequence, as a function of the results of digital simulations or pool trials. However, it was noted that a positive result was more easily obtained if the base 12 and the deck 16 were flat and relatively close to each other, which justifies the fuselage being wider than it is high. One also tries to increase the friction produced by the vertical movement of the water in order to damp down the oscillation of the float 5; the almost sharp angles of the edges 24 of the fuselage 6, as well as the horizontal fins 15, provide this result by creating eddies.

Other considerations concern the stabilisation of the forward movement of the float 5. It is normal to improve it by providing the floats with appendages, which can however increase the towing force and to elongate them towards the rear. Such appendages are not needed here, where the leg 7 works as a rudder, the vertical fin 14 having the same effect if it is added. The leg 7 is best set behind the fuselage 6, and the coupling 19 also as far to the front as possible so that it does not upset the balance of the float 5, in front of the leg 7 or at least the greater part of it. The centre of the hull of the float 5 must be brought forward and its centre of gravity moved backward. The flattening of the fuselage 6 and the reduction of its resulting lateral surface is also positive concerning this, since the lateral disturbances produced by the water will be reduced.

In general, it is preferable not to place ballast in the float 5, which could make it more stable but which would increase its mass and its displacement.

What is claimed is:

1. Float (5) for a towed line, comprising a horizontal portion (6) with a fuselage shape, characterised in that it comprises an upper portion (7), extending upwards from the horizontal portion and in that the horizontal portion is completely submerged, and the upper portion is partly emerged, when the float supports an element (1) of the line.

2. Float according to claim 1, characterised in that the upper portion (7) rises at the rear of the horizontal portion (6).

3. Float according to claim 2, characterised in that a suspension element (19) of a portion (1) of the line, located under the horizontal portion, is also set in front of at least the greater part of the upper portion (7).

4. Float according to claim 3, characterised in that the suspension element (19) comprises a single articulation (25), which has a transversal axis.

5. Float according to any one of claims 1 to 4, characterised in that the horizontal portion (6) is wider than it is high.

6. Float according to claim 5, characterised in that the horizontal portion has a base (12) and an upper deck (16), both partially flat.

7. Float according to claim 6, characterised in that the horizontal portion has closely rectangular cross-sections.

8. Float according to claim 5, characterised in that it comprises a base with a rising step (13) at the rear, vertical fins (14) being housed in the step.

9. Float according to claim 1, characterised in that it comprises horizontal fins (15) on the horizontal portion (6).

10. Float according to claim 1, characterised in that the upper portion (7) has substantially uniform horizontal cross-sections.

11. Float for a towed line, comprising a horizontal portion with a fuselage shape, characterised in that it comprises an upper portion, extending upwards from the horizontal portion and in that the horizontal portion is completely submerged, and the upper portion is partially emerged, when the float supports an element of the line, both the horizontal portion and the upper portion being floating bodies.

12. Float according to claim 11, characterised in that the upper portion rises at the rear of the horizontal portion.

13. Float according to claim 12, characterised in that a suspension element of a portion of the line, located under the horizontal portion, is also set in front of at least the greater part of the upper portion.

14. Float according to claim 13, characterised in that the suspension element comprises a single articulation, which has a transversal axis.

15. Float according to claim 11, characterised in that the horizontal portion is wider than it is high.

16. Float according to claim 15, characterised in that the horizontal portion has a base and an upper deck, both partially flat.

17. Float according to claim 16, characterised in that the horizontal portion has closely rectangular cross-sections.

18. Float according to claim 15, characterised in that it comprises a base with a rising step at the rear, vertical fins being housed in the step.

19. Float according to claim 11, characterised in that it comprises horizontal fins on the horizontal portion.

20. Float according to claim 11, characterised in that the upper portion has substantially uniform horizontal cross-sections.

21. Float according to claim 1, wherein the upper portion has a half-cylinder front part and the horizontal portion has a rounded front end.

22. Float according to claim 21, wherein both the upper portion and horizontal portion have rear parts tapering rearwardly.

* * * * *